United States Patent [19]

Brueckner et al.

[11] Patent Number: 5,052,175

[45] Date of Patent: Oct. 1, 1991

[54] STEAM POWER PLANT

[75] Inventors: Hermann Brueckner, Uttenreuth; Werner Emsperger, Erlangen; Hans-Joachim Neumann, Clausthal-Zellerfeld, all of Fed. Rep. of Germany

[73] Assignee: Siemens Aktiengesellschaft, Munich, Fed. Rep. of Germany

[21] Appl. No.: 341,785

[22] Filed: Apr. 21, 1989

[30] Foreign Application Priority Data

Apr. 27, 1988 [DE] Fed. Rep. of Germany ..... 3814242

[51] Int. Cl.[5] ..... F02C 3/20; B01D 3/00

[52] U.S. Cl. ..... 60/39.463; 208/369

[58] Field of Search ..... 60/39.182, 39.463, 39.12; 208/369

[56] References Cited

U.S. PATENT DOCUMENTS

| | | | |
|---|---|---|---|
| 1,904,213 | 4/1933 | Ewing et al. | 208/369 |
| 1,971,214 | 8/1934 | Dubbs | 208/369 |
| 2,895,297 | 7/1959 | Gardiner | 60/39.461 |
| 3,207,675 | 9/1965 | Gladieux | 208/369 X |
| 4,193,259 | 3/1980 | Muenger et al. | 60/39.182 |

FOREIGN PATENT DOCUMENTS

| | | |
|---|---|---|
| 0081895 | 6/1983 | European Pat. Off. . |
| 1034299 | 7/1958 | Fed. Rep. of Germany . |
| 829966 | 6/1958 | United Kingdom . |

*Primary Examiner*—Louis J. Casaregola
*Assistant Examiner*—John A. Savio, III
*Attorney, Agent, or Firm*—Herbert L. Lerner; Laurence A. Greenberg

[57] ABSTRACT

A steam power plant for producing energy from tarry residual oils from a refinery includes a steam generator as well as a combustion system heating the steam generator and having a fuel side. A fired tubular furnace for heating high-viscosity refinery residues to 400° to 600° C., for instance, produces gaseous and vaporous products and other components of the residue. A separating column connected downstream of the fired tubular furnace separates the gaseous and vaporous products from the other components of the residue. The separating column has a lower end and an outlet line at the lower end connected upstream of the fuel side of the combustion system for the other components of the residue.

7 Claims, 2 Drawing Sheets

STEAM POWER PLANT

Figure 1:
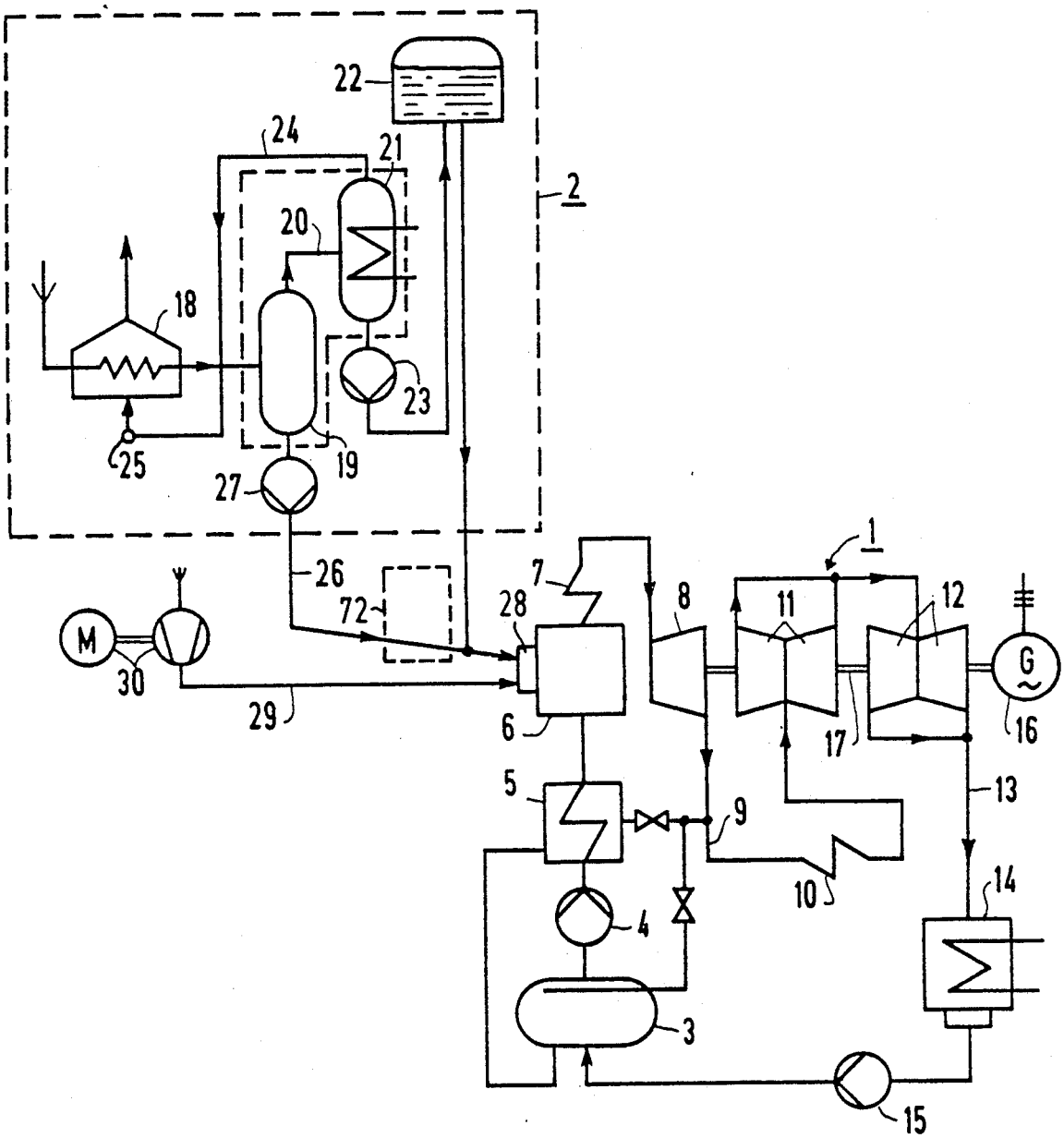

The invention relates to a steam power plant having a steam generator heated by a combustion system.

The steam generators of such steam power plants can often be heated with heavy oil. Although this kind of heating requires less capital investment than heating with pulverized coal, for instance, it entails relatively high fuel costs.

In petroleum refineries, the crude oil is split in separating columns connected in series with one another into various fractions which differ according to their boiling points. What is left at the end is a residue of highly viscous to tarry consistency, which is difficult to sell. Usually, it is used in the asphalt industry. Attempts to burn this more-expensive, high-viscosity refinery residue in power plants have thus far been aimed in two different directions:

First, mixing these high-viscosity refinery residues with more valuable, less-viscous fractions was attempted, in order to reduce their viscosity enough that they could again be pumped at temperatures that were not-excessively high and atomized in burners. However, the trade-off was that some of the cost advantage of these highly-viscous refinery residues was lost.

Pumping these high-viscosity refinery residues at correspondingly high temperatures, at which they are still fluid, and then burning them after heating them further, was also tried. However, since proper combustion is possible only after such hydrocarbons are atomized, but atomization requires an even lower viscosity (approximately 25 cSt) than that which is sufficient for pumping, further heating prior to combustion is necessary. However, at the high temperature required for this, the danger of uncontrolled ignition is increased. Furthermore, because of the high temperature level required, such heating necessitates tapping into the high-pressure portion of the steam turbine, or using fresh steam. A further factor making the entire procedure more difficult is that sulfur and components that cause corrosion are present in concentration in these high-viscosity residues. The flue gas produced after combustion can cause both high-temperature and low-temperature corrosion.

It is accordingly an object of the invention to provide a steam power plant, which overcomes the hereinaforementioned disadvantages of the heretofore-known devices of this general type and which permits the highly-viscous refinery residues to be reasonably combusted completely in the power plant. Moreover, the cost advantage of these refinery residues should not be wasted by excessively high expenses in the power plant nor by the additional purchase of more-expensive fuels.

With the foregoing and other objects in view there is provided, in accordance with the invention, a steam power plant, comprising a steam generator, a combustion system heating the steam generator and having a fuel side, a pipe furnace for heating high-viscosity refinery residues to 400° to 600° C., for instance, and producing gaseous and vaporous products and other components of the residue, and a separating column connected downstream of the pipe furnace for separating the gaseous and vaporous products from the other components of the residue, the separating column having a lower end and an outlet line at the lower end connected upstream of the fuel side of the combustion system for the other components of the residue.

Since the fuel side of the combustion system of the steam generator is preceded by a pipe furnace for heating high-viscosity refinery residues to 400° to 600° C., which is followed by a separating column for separating the gaseous and vaporous products of the other residue components, with the outlet line for the other residue components connected from the lower end of the separating column to the combustion system of the steam generator, these high-viscosity refinery residues can be utilized for steam generation without being mixed with more-expensive, lighter-weight refinery products. Thermal cracking takes place in the pipe furnace, which breaks apart the long hydrocarbon chains that are responsible for the high viscosity. The result is a mixture of hydrocarbons of overall reduced viscosity. This viscosity is reduced to such an extent that even the fraction that can be drawn off from the lower end of the separating column can be pumped and stored at a substantially lower temperature and no longer needs to be heated as much for combustion in heavy-oil burners.

Although it is known in the petrochemical industry to crack the distillation products of higher viscosity at increased temperatures in order to increase the yield of light weight fractions, nevertheless a high-viscosity residue is always left, which previously could only be sold essentially to the asphalt industry. However, by using the technology for heavy oil combustion, the invention of the instant application makes it possible to utilize this portion completely for energy production as well.

In accordance with another feature of the invention, the separating column has an upper end and another outlet line at the upper end, and there is provided a condensation apparatus into which the other outlet line discharges, the condensation apparatus having a top product serving as heating medium for the pipe furnace. This provision makes it unnecessary to purchase a special heating medium for operating the pipe furnace.

In accordance with a further feature of the invention, the condensation apparatus has a lower end from which a product is drawn off and supplied to the combustion system. By mixing the less-viscous fraction obtained in the cracking process, a further reduction in the viscosity of the fraction drawn off at the lower end of the separating column and fed into the combustion chamber of the steam generator is attained.

In accordance with an added feature of the invention, there is provided a gas turbine power plant connected upstream of the steam generator for feeding exhaust gases as heat transfer and oxygen carrying media to the combustion system, the gas turbine power plant having a gas turbine and a combustion chamber connected to the gas turbine; and a condensation apparatus having a lower end from which a product is drawn off and supplied as fuel to the combustion chamber.

This provides a particularly advantageous structure, which at the same time brings particularly high efficiency of the power plant. In this case, the already very high overall efficiency of a combined gas and steam turbine power plant is augmented by the advantage that the gas turbine can likewise be driven, although indirectly, by the high-viscosity refinery residues, since the corrosive components of the product used remain in the heavy residues that are drawn off at the lower end of the separating column and thus do not reach the particularly vulnerable gas turbine.

In accordance with an additional feature of the invention, there is provided a reservoir, and another outlet line directly connected between the reservoir and the lower end of the condensation apparatus for the product drawn off at the lower end of the condensation apparatus, the other outlet line also being connected from the reservoir to the combustion system and the combustion chamber as well in the embodiment having a combustion chamber.

In accordance with yet another feature of the invention, there is provided a reservoir directly connected between the outlet line and the combustion system for the other components of the residue from the lower end of the separating column.

In accordance with yet a further feature of the invention, the pipe furnace heats the refinery residues to 450° to 500° C.

In accordance with a concomitant feature of the invention, the separating column and the condensation apparatus are combined.

Other features which are considered as characteristic for the invention are set forth in the appended claims.

Although the invention is illustrated and described herein as embodied in a steam power plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
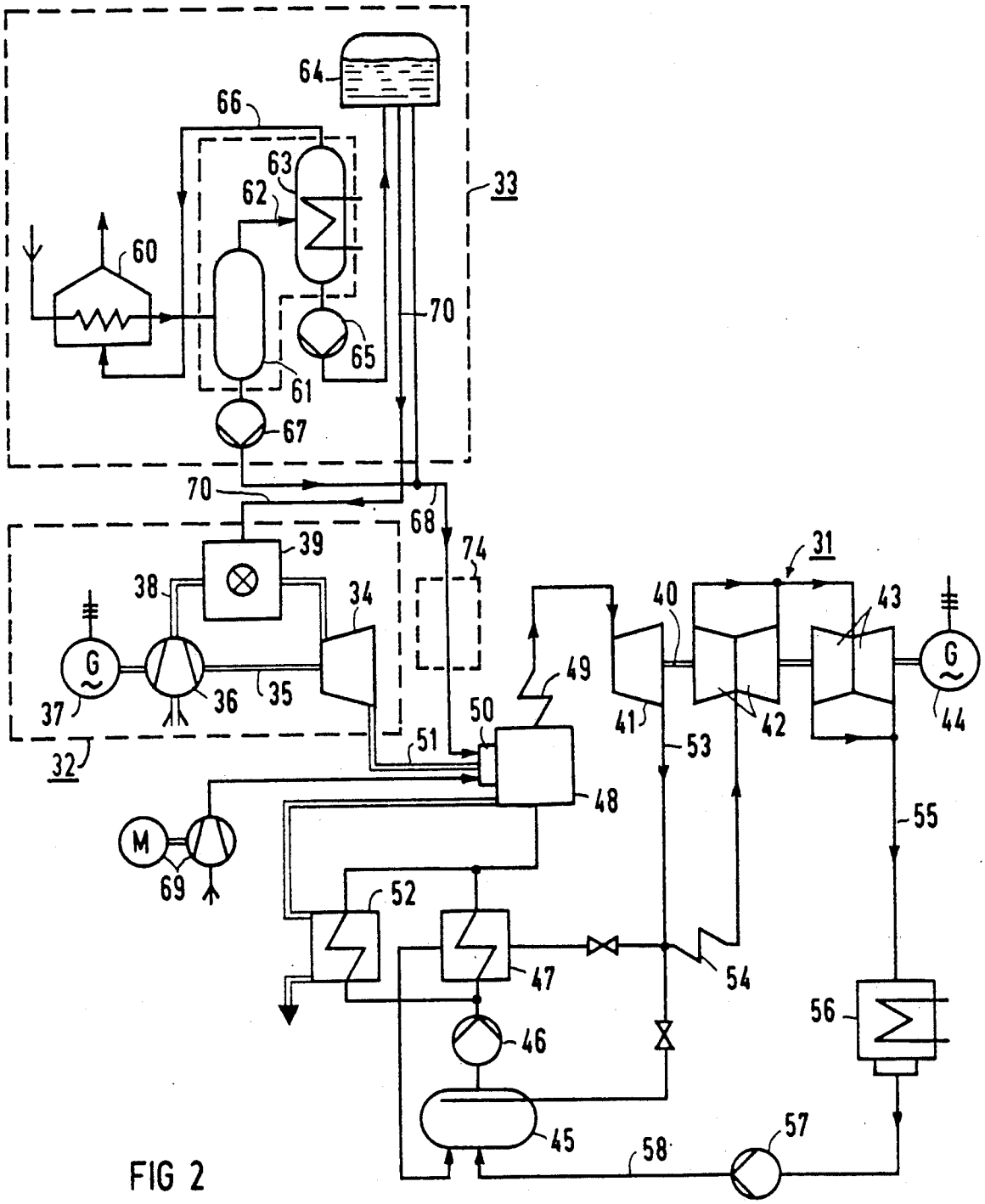

FIG. 1 is a schematic circuit diagram of a steam turbine power plant preceded by a system for preparing high-viscosity refinery residues; and FIG. 2 is a schematic circuit diagram of a combined gas and steam turbine power plant, with a system for preparing high-viscosity refinery residues.

Referring now to the figures of the drawing in detail and first, particularly, to FIG. 1 thereof, there is seen a steam turbine power plant 1, preceded by a system 2 for preparing high-viscosity refinery residues. As can be seen in the schematic drawing of the steam turbine power plant, a feedwater container 3 is connected in series with a feedwater pump 4, a feedwater preheater 5, a steam generator 6 and a superheater 7, and a high-pressure steam turbine 8 is connected to the superheater. A steam vent line 9 of the high-pressure steam turbine 8 is connected through an intermediate superheater 10 to a medium-pressure steam turbine 11 and a low-pressure steam turbine 12. A steam vent line 13 of the low-pressure steam turbine 12 is connected to a condensor 14, which communicates through a condensate pump 15 with the feedwater container 3. The steam vent line 9 of the high-pressure steam turbine 8 is also connected to the feedwater preheater 5 and the feedwater container 3. The high-pressure, medium-pressure and low-pressure steam turbines, along with a generator 16 that is to be driven, are all mounted on a common shaft 17.

The system 2 for preparing the high-viscosity refinery residues includes a pipe furnace 18, a separating column 19 connected thereto, a condensation apparatus 21 which is connected to an outlet line 20 on the top of the separating column 19 and may also be combined with the separating column, and a reservoir 22 for a liquid fraction drawn off at the lower end of the condensation apparatus 21 by means of a feed pump 23. An outlet line 24 on the top of the condensation apparatus 21 is connected to a fuel supply line 25 of the pipe furnace 18. An outlet line 26 at the lower end of the separating column 19 is provided with a feed pump 27 and is connected to a combustion system in the form of heavy oil burners 28 of the steam generator 6. Once again, a reservoir can be disposed between them. Also discharging into the burners is a fresh-air line 29, which is supplied by a motor-driven fresh-air blower 30. On the outlet side, the reservoir 22 is also connected to the outlet or fuel line 26 leading to the heavy oil burners 28 of the steam generator.

When the steam turbine power plant 1 is operating, preheated, high-viscosity refinery residues enter the pipe furnace 18 in a manner which is not shown in further detail herein, and are heated there to between 450° and 500° C. in the exemplary embodiment. The lengths of heating coils in the pipe furnace are selected as a function of the intended flow speed in such a way that the high-viscosity refinery residues are exposed for several minutes to a temperature above 450° C. At this temperature, the long molecular chains break, producing shorter and even quite short hydrocarbon chains. In the course of this process, the viscosity is greatly reduced. The mixture of hydrocarbons which is thus formed and which flows well at this temperature reaches the separating column 19. There, it is separated into a gaseous or vaporous fraction that can be drawn off at the top of the separating column, and a liquid fraction that collects at the lower end of the separating column 19. The gaseous and vaporous component that can be drawn off at the top of the separating column 19, at approximately 400° to 450° C. in the exemplary embodiment, is then cooled down in the condensation apparatus 21, which is constructed as a separating column, to approximately ambient temperature. A fraction which is liquid at this temperature collects at the lower end of the condensation apparatus 21. A gaseous fraction can also be drawn off at this temperature at the top of the condensation apparatus. This gaseous fraction is drawn off at the top of the condensation apparatus 21 through the outlet line 24 and supplied to the pipe furnace 18 as fuel. The fraction produced at the lower end of the separating column 19, which is liquid at the temperature of approximately 400° C. prevailing there, is pumped through the further feed pump 27 into the heavy oil burners 28 of the steam generator 6, where it is combusted together with the fresh air pumped by the fresh-air blower 30. It could also be temporarily stored in a heated reservoir 72 and drawn out as needed. The liquid fraction collecting at the lower end of the condensation apparatus 21 is pumped through the feed pump 23 into the reservoir 22. It can be drawn off from there as needed and mixed into the line 26 leading to the heavy oil burners 28. However, it can also be delivered for some other separate use instead.

The steam produced in the steam generator 6 is dried and superheated in the superheater 7 and carried into the high-pressure steam turbine 8. The exhaust steam of the high-pressure steam turbine is reheated in the intermediate superheater 10 and is supplied as medium-pressure steam to the medium-pressure steam turbine 11 mounted on the common shaft 17 and to the low-pressure steam turbine 12 connected in series with the medium-pressure steam turbine 11. The exhaust steam of the low-pressure steam turbine 12 is condensed in the condensor 14, and the condensate produced is pumped through the condensate pump 15 into the feedwater container 3. The feedwater is pumped from the feedwater container through the feedwater pump 4 into the feedwater preheater 5 and from there back into the steam generator. The feedwater preheater 5 may be heated by a portion of the exhaust steam of the high-pressure steam turbine 8, which is diverted from the exhaust steam line 9.

With this kind of construction of a steam turbine power plant 1, the power plant can be driven with the high-viscosity refinery residues that otherwise are difficult and therefore expensive to use (for instance in the asphalt industry). The additional expense required for this purpose, in the form of a system 2 for preparing high-viscosity refinery residues, is within limits and does not require additional fuels.

The exemplary embodiment of FIG. 2 has a steam turbine power plant 31 preceded by a gas turbine power plant 32 and a system 33 preceding both of them, for preparing high-viscosity refinery residues. The gas turbine power plant 32 includes a gas turbine 34 having an air compressor 36, a generator 37 mounted on the same common shaft 35, and a combustion chamber 39 connected to a fresh-air line 38 of the air compressor.

Similarly to the exemplary embodiment of FIG. 1, the steam turbine power plant 31 has high-pressure, medium-pressure and low-pressure steam turbines 41, 42 and 43, respectively, mounted on the same common shaft 40 and driving a generator 44. Connected to an associated feedwater container 45 of the steam turbine power plant 31 are a feedwater pump 46, a feedwater preheater 47 and a steam generator 48 having superheater heating surfaces 49. As in the exemplary embodiment of FIG. 1, the steam generator 48 is heated by a combustion system in the form of heavy oil burners 50. The hot exhaust gases from the gas turbine 34 are supplied through an exhaust line 51 to the heavy oil burners and serve as oxygen carriers for the burners. The exhaust gases leave the steam generator 48 at relatively high temperature and are therefore subsequently utilized for feedwater preheating in a feedwater preheater 52. This flue-gas-heated feedwater preheater 52 is connected in parallel with the previously mentioned feedwater preheater 47, which is heated by a portion of the exhaust steam of the high-pressure steam turbine 41. An exhaust steam line 53 of the high-pressure steam turbine 41 is connected through an intermediate superheater heating surface 54 to the medium-pressure steam turbine 42. An exhaust steam line 55 of the low-pressure turbine 43 leads into a condensor 56. Connected to the condensor 56 is a condensate line 58 leading to the feedwater container 45 and being equipped with a condensate pump 57.

The system 33 for preparing high-viscosity refinery residues is identical to the equivalent system 2 of the exemplary embodiment of FIG. 1 and therefore includes a pipe furnace 60, a separating column 61 connected thereto, a condensation apparatus 63 connected to an outlet line 62 at the top of the separating column, and a reservoir 64 for the liquid fraction drawn off by a feed pump 65 at the lower end of the condensation apparatus 63. The condensation apparatus 63 may also be combined with the separating column 61. Once again, the gaseous fraction drawn off at the top of the condensation apparatus through an outlet line 66 is supplied to the pipe furnace 60 as fuel, and an outlet line 68 for the liquid fraction drawn off at the lower end of the separating column is connected through a further feed pump 67 and optionally through a reservoir 74 to the steam generator 48 of the steam turbine power plant 31. However, contrary to the exemplary embodiment of FIG. 1, a fuel line 70 leading back to the reservoir 64, for the fraction which is liquid at ambient temperature in the exemplary embodiment, is additionally connected to the combustion chamber 39 of the gas turbine 34.

In operation of the gas and steam turbine power plant of the exemplary embodiment of FIG. 2, the gas turbine 34 is driven with the fraction at the lower end of the condensation apparatus 63. The fraction is drawn from the reservoir 64 and is liquid at ambient temperature. This liquid fraction is combusted in the combustion chamber 39 with the fresh air from the air compressor 36 of the gas turbine power plant 32 and supplied to the gas turbine 34. The air compressor and the generator 37 mounted on the same shaft 35 are driven in this process. The exhaust gas from the gas turbine flows as a heat transfer medium and oxygen carrier into the heavy oil burners 50 of the steam generator 48 of the steam turbine power plant 31 and then, as flue gas, through the feedwater preheater 52. The heavy fraction drawn off at the lower end of the separating column 61 is pumped through the feed pump 67 into the heavy oil burners 50 of the steam generator 48.

As in the exemplary embodiment of FIG. 1, the steam generated in the steam generator 48 and dried and superheated in the superheater 49 is supplied to the high-pressure steam turbine 41 and is carried through the intermediate superheater 54 into the medium-pressure steam turbine and from there into the low-pressure steam turbine. These three steam turbines drive the generator 44 mounted on the same shaft 40. The exhaust steam of the low-pressure steam turbine 43 is condensed in the condensor 56. The condensate is pumped through the condensate pump 57 into the feedwater container 45, and the feedwater is pumped back through the feedwater pump 46 into the feedwater preheaters 47, 52 and to the steam generator 48. In this process, shown in FIG. 2, a portion of the feedwater is preheated through the flue-gas-heated feedwater preheater 52. As a result, an additional quantity of steam is available to the medium-pressure steam turbine 42 and the low-pressure steam turbine 43, as compared with the exemplary embodiment of FIG. 1.

In this gas and steam turbine power plant, the combustion chamber 39 of the steam turbine 34 is operated with the fraction at the lower end of the condensation apparatus 63, which is liquid at ambient temperature. Depending on the power required, a corresponding larger or smaller quantity of fuel can be drawn from the reservoir 64. There is also the option of mixing this fraction, which is liquid at ambient temperature, with the fraction in the outlet line 68, which is liquid at the elevated temperature of the separating apparatus 61, and thus to further reduce its viscosity. If there is a malfunction in the gas turbine system, the steam block can also be operated independently, with a fresh-air blower 69.

The foregoing is a description corresponding in substance to German Application P 38 14 242.2, dated Apr. 27, 1988, the International priority of which is being claimed for the instant application, and which is hereby made part of this application. Any material discrepancies between the foregoing specification and the aforementioned corresponding German application are to be resolved in favor of the latter.

What is claimed is:

1. Steam power plant for producing energy from tarry residual oils from a refinery, comprising a steam generator, a combustion system heating said steam generator and having a fuel side, a fired tubular furnace for heating the refinery residual oils to 400° to 600° C. and producing gaseous and vaporous products and other components thereof, a separating column connected downstream of said fired tubular furnace for separating the gaseous and vaporous products from the other components, said separating column having a lower end and an outlet line at said lower end connected to said fuel side of said combustion system for supplying the other components to said combustion system, said separating column having an upper end and another outlet line at said upper end, and including a condensation apparatus into which said other outlet line discharges, and said condensation apparatus having a top product serving as heating medium for said fired tubular furnace.

2. Steam power plant according to claim 1, wherein said condensation apparatus has a lower end from which a product is drawn off and supplied to said combustion system.

3. Steam power plant according to claim 1, including a gas turbine power plant connected upstream of said steam generator for feeding exhaust gases as heat transfer and oxygen carrying media to said combustion system, said gas turbine power plant having a gas turbine and a combustion chamber connected to said gas turbine; said condensation apparatus having a lower end from which a product is drawn off and supplied to said combustion chamber.

4. Steam power plant according to claim 3, including a reservoir connected between said lower end of said condensation apparatus and said combustion chamber for the product drawn off at said lower end of said condensation apparatus, and an outlet line being connected from said reservoir to said combustion system.

5. Steam power plant according to claim 2, including a reservoir connected between said lower end of said condensation apparatus and said combustion system for the product drawn off at said lower end of said condensation apparatus.

6. Steam power plant according to claim 1, wherein said separating column and said condensation apparatus are combined.

7. Steam power plant for producing energy from tarry residual oils from a refinery, comprising a steam generator, a combustion system heating said steam generator and having a fuel side, a fired tubular furnace for heating the refinery residual oils and producing gaseous and vaporous products and other components thereof, and a separating column connected downstream of said fired tubular furnace for separating the gaseous and vaporous products from the other components, said separating column having a lower end and an outlet line at said lower end connected to said fuel side of said combustion system for supplying the other components to said combustion system, and said separating column having an upper end and another outlet line at said upper end, and including a condensation apparatus into which said other outlet line discharges, and said condensation apparatus having a top product serving as heating medium for said fired tubular furnace.

* * * * *